United States Patent [19]

Miller

[11] 4,288,040

[45] Sep. 8, 1981

[54] LOW PROFILE CRUSHING APPARATUS

[75] Inventor: Harold J. Miller, Galion, Ohio

[73] Assignee: Eagle Crusher Company, Inc., Galion, Ohio

[21] Appl. No.: 110,708

[22] Filed: Jan. 9, 1980

Related U.S. Application Data

[63] Continuation-in-part of Ser. No. 904,906, May 11, 1978, abandoned.

[51] Int. Cl.[3] ..... B02C 1/04

[52] U.S. Cl. ..... 241/263; 241/265; 241/267

[58] Field of Search ..... 241/267, 264, 262, 263, 241/265, 266, 268, 269

[56] References Cited

U.S. PATENT DOCUMENTS

| | | | |
|---|---|---|---|
| 2,127,027 | 8/1938 | Hallenbeck | 241/267 |
| 2,264,915 | 12/1941 | Meister | 241/267 |
| 2,921,750 | 1/1960 | Picalarga | 241/267 |
| 3,219,287 | 11/1965 | Weiss | 241/267 |
| 3,958,767 | 5/1976 | Stiles | 241/265 X |
| 4,124,170 | 11/1978 | Braun et al. | 241/267 X |

*Primary Examiner*—Howard N. Goldberg
*Attorney, Agent, or Firm*—Francis T. Kremblas, Jr.

[57] ABSTRACT

An apparatus for crushing mine ore or hard rock primarily for initial reduction for transport of the material for further processing which is characterized by an extremely low vertical profile relative to its size and capacity. The crushing jaws which form the crushing chamber are uniquely arranged in an inclined relationship with the lower jaw mounted for eccentric movement relative to the upper jaw which is stationary to provide efficient crushing action and efficient movement of the crushed material through the chamber while also permitting the associated inlet feed apparatus to be disposed at a low attitude. Means are included to provide for varying the size of the discharge opening and for varying the action of the moveable crushing jaw to permit greater versatility in the proper processing of a given material.

4 Claims, 3 Drawing Figures

LOW PROFILE CRUSHING APPARATUS

The Government has rights in this invention pursuant to Contract No. J0285003 awarded by the Bureau of Mines, U.S. Department of the Interior.

BACKGROUND

This is a continuation-in-part of my co-pending application Ser. No. 904,906 filed May 11, 1978, now abandoned.

Particularly as applied to underground mining operation, a reliable, efficient and low profile portable underground hard rock crusher has long been needed to improve underground ore handling system. One of the primary causes of low productivity in underground mines is the inefficient ore handling which is currently experienced.

Studies sponsored by the U.S. Bureau of Mines have documented the long-felt need for such a crushing apparatus which would make possible more efficient use of currently operated conveyor systems by bringing haulage closer to the face of the mine and eliminate expensive rock handling procedures. Estimates of as much as a 50% increase in productivity could be realized if primary reduction crushing apparatus could be employed at an earlier stage to permit smaller beltable material to be available close to the working site.

Present crushing apparatus having the required capacity for primary reduction application in this area are not easily transported and require too much head space for economical installation close to working areas to obtain optimum haulage from the face to the dump locations.

Prior art hard rock crushers which are currently well-known in the industry and used in hard rock crushing applications, such as the gyratory, Blake type, overhead eccentric and cone crushers, all have relatively high profiles for comparable capacity ranges to be employed to appropriately solve the ore handling problems presently facing the industry.

It has also been noted in a government sponsored study, the Rapidex report under USBM Contract No. J0265006 that an eccentric jaw crusher with overhead feed is unsuitable and that apparent use of an eccentric jaw crusher which has been turned on it's side for horizontal feed through the crushing chamber is not suitable do to the difficulty of conveying the material through the chamber and the need for a chain conveyor disposed near or adjacent to the length of the crushing chamber.

Other types of prior crushing apparatus which are of low profile design are not suitable for hard rock applications or do not possess the required size and throughput capacity for practical use in such applications. According to the same study, a rotary type jaw crusher has been proposed to attempt to meet the needs mentioned above. However, as compared to the present invention, I believe that such a crusher has serious limitations in the context of these described applications which will prove it to be less satisfactory.

SUMMARY OF THE INVENTION

The present invention relates generally to portable hard rock crushing apparatus and particularly to a novel low head room or low profile crusher which will provide a reliable, efficient crushing operation in underground mining operations closer to the active working areas for primary reduction of ore or hard rock for easier and more efficient ore handling of the material.

The present invention is characterized by its novel crushing jaw design which combines eccentric crushing action and a lower feed inlet in an efficient space-saving construction which provides comparable capacity in a much lower head room design in a reliable, efficient rock crusher. This low profile is achieved by a novel arrangement of the crushing jaws and the attendent arrangement of the remaining necessary components.

In the present invention, unlike prior art eccentric crushers, the crushing jaws are inclined to form an inclined crushing chamber sloping downwardly from inlet to discharge with the lower jaw being movable to impart the crushing action between it and the stationary upper jaw.

This arrangement of the jaws provides a powerful and most efficient crushing of material while maintaining very adequate feeding of the material through the crushing chamber.

Additionally, the arrangement of the crusher jaws in this manner permits the attendent eccentric shaft, drive means, and movable jaw support to be positioned in a lower profile manner on the frame as well as reduce the height at which the conveyor system feeds the inlet of crusher chamber to permit the feeding system to be mounted at a lower position on the frame.

OBJECTS

It is a primary object to provide a portable, low head room, hard rock crusher which has a drammatically reduced profile compared to prior art apparatus suitable for use in underground mine applications.

It is another object of the present invention to provide an apparatus of the type described wherein the capacity of the crushing chamber is comparably equal to prior art crushers which require significantly greater head room than required by apparatus constructed in accordance with the present invention.

It is another object of the present invention to provide an apparatus of the type described which may be more easily and efficiently transported from site to site compared to prior art hard rock crushers.

It is a further object of the present invention to provide an apparatus of the type described which includes the aforementioned features and yet is of comparable ease to manufacture and maintain relative to prior art head rock crushers.

It is still another object of the present invention to provide an apparatus of the type described which may be advantageously utilized much closer to the working areas of underground mines for greatly improving ore handling and production in such mines.

It is another object of the present invention to provide an apparatus of the type described wherein the disposition of the movable jaw and its associated eccentric drive means not only contribute to the lower head room requirement but further assures efficient transport of the crushed material from the crushing chamber inlet to the discharge opening.

Further objects and advantages of the present invention will be apparent from the following description, references being had to the accompanying drawings wherein a preferred form of embodiment of the invention is clearly shown.

IN THE DRAWINGS

DETAILED DESCRIPTION

Figure 1:
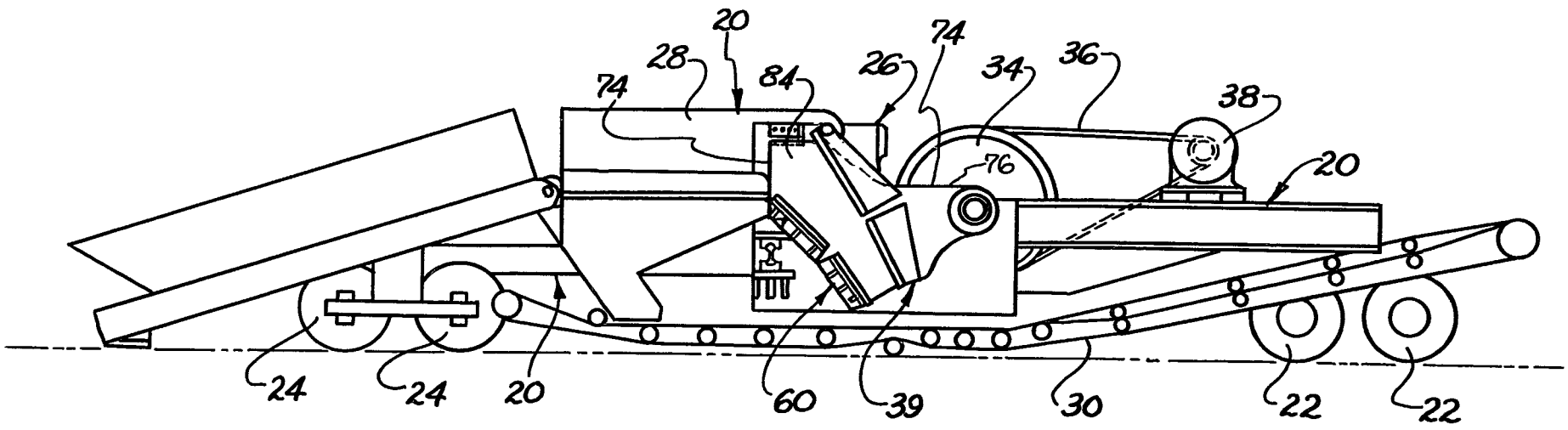
FIG. 1 is a side elevational view of a portable, hard rock, low profile crusher apparatus construction in accordance with the present invention and shown with associated feed and discharge conveying systems.

A portable, low profile, hard rock crushing apparatus constructed in accordance with the present invention is illustrated in FIG. 1 and includes a main frame, indicated generally at 20, which is supported for movement by several pair of conventional wheel means such as at 22 and 24.

The crushing portion of the apparatus, indicated generally at 26, is centrally located on the frame adjacent to a conveyor system 30. The feed and discharge conveyor system are of conventional nature and a variety of standard types could be employed within the context of the present invention. Further a typical scalping mechanism is usually included to remove fines or the like prior to entry into the crushing chamber.

A shaft means 32 carrying an eccentric bearing is operatively connected to a pair of fly wheels, such as at 34, which in turn are driven via a belt drive 36 connected to a conventional motor 38. Each of these components may be mounted on the frame in any conventionally suitable manner.

Figure 2:
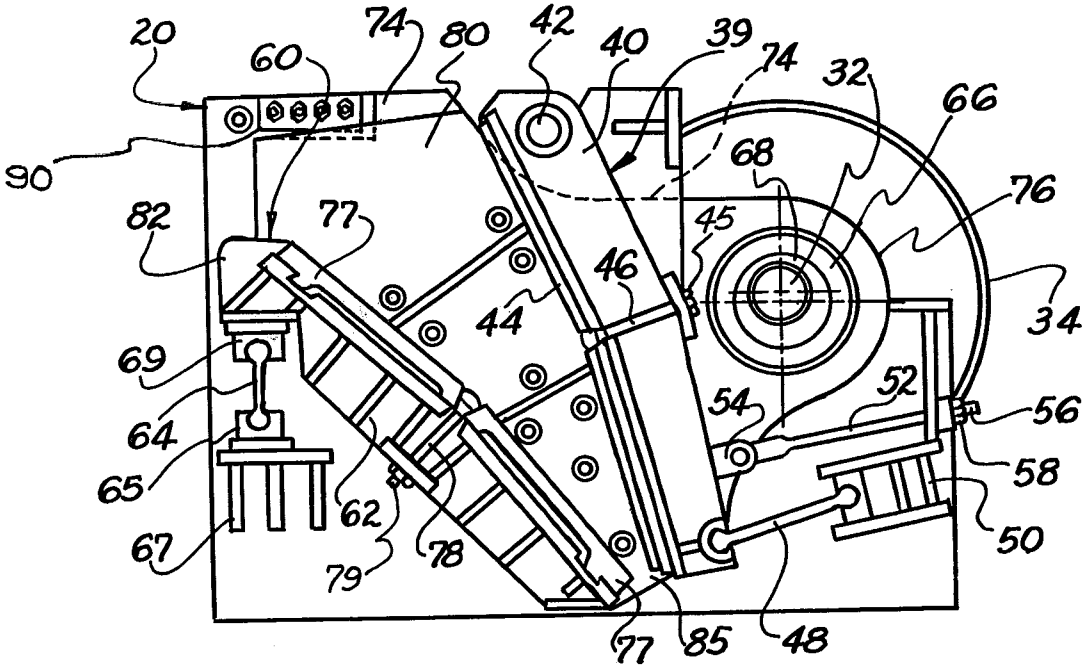
FIG. 2 is a partial side elevational view of the apparatus shown in FIG. 1 illustrating the eccentric driven crushing jaw means and crushing chamber shown apart from the associated main frame and assessory equipment.
Figure 3:
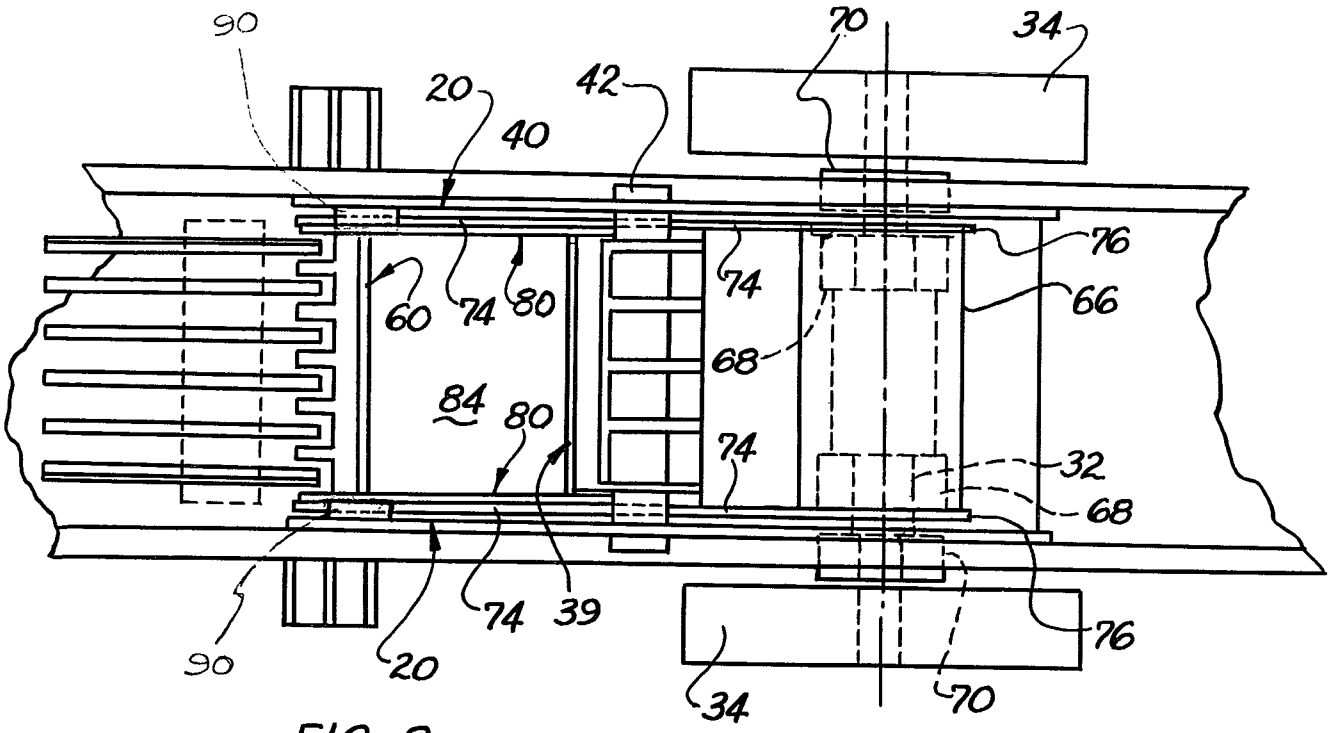
FIG. 3 is a top plan view of substantially that portion of the apparatus shown in FIG. 2.

Now referring specifically to FIGS. 2 and 3, the crushing apparatus 26 is shown in greater detail and includes a stationary jaw means, indicated generally at 39, which includes supporting frame 40 mounted for pivoted movement at its upper end via a shaft 42, which in turn, is supported at each end to main frame 20 in a conventional manner. A replacable jaw liner 44 comprising a highly wear resistant material, such as manganese for example, is releasably fixed to supporting frame 40 by means of threaded wedge-like member 46 provided with a locking bolt 45 which draws the head of member 46 into a fixed engagement with each side of liners 44.

The lower end of the stationary jaw means is releasably fixed in position by a toggle arrangement 48 provided with a series of shim 50 which may be easily used to adjust the position of frame 40 pivoted about shaft 42 to vary the discharge opening between the jaws.

Toggle arrangement 48 is held in place by means of a plurality of rods 52 pivotally mounted to flanges, such as 54, carried by support 40 and provided with a threaded end 56 carrying a nut 58 extended through a suitable hole in main frame 20. By simple manipulation of nuts 58 and shims 50, jaw means 39 may be pivoted and locked into a new position.

It should be pointed out that stationary jaw means 39 is inclined relative to the horizontal, sloping downwardly from the feed inlet of the crushing chamber to the discharge outlet.

A movable jaw means, indicated generally at 60, includes a supporting frame or pitman 62. The upper end of pitman 62 is supported by a toggle arrangement indicated generally at 64, located beneath the feeder end. The upper and lower ends of pitman 62 are attached to a tube-like support 66 carrying rotatable eccentric bearings 68 which are mounted on shaft 32.

A pair of main frame bearing 70 are mounted on the main frame and connected to shaft 32. Each end of shaft 32 is mounted to a fly wheel 34 provided with counter weights to offset the unbalanced weight of pitman 62.

One of the fly wheels 34 is connected to a conventional electric motor 38 via belt drive 36 to provide rotary power to shaft 32.

It should be pointed out that pitman 62 includes side plates 74 and the extended collar-like portion 76 which is connected to tube-like support 66 such that the eccentric motion of shaft 32 is imparted to pitman 62 and the replacable jaw liner 77.

Therefore it should be understood that tube-like support 66, side plates 74 with their collar portions 76 are fixed to one another to form a unitary structure with support frame or pitman 62.

The rotation of shaft 32 and eccentric bearings members 68 carried by the shaft and mounted for rotation within support 66 causes the tube-like support member 66 and the side plates 74, collar portion 76 and hence pitman 62 to move relative to the eccentric motion imparted by the off-center motion of bearings 68.

In conjunction with toggle support arrangement 64 at the upper or feed end of pitman 62, the eccentric motion created by rotation of shaft 32 as described is translated into right to left motion of the pitman 62 carrying jaw liner 77.

Jaw liner 77 is removably mounted to pitman 62 by a threaded wedge member 78 and its companion bolt 79. Drawing the enlarged head portion of member 78 between the liners 77 drives downwardly depending flange portions into appropriate slots provided in support frame 62 in a conventional manner. However, other conventional forms of removably mounting jaw liners to the jaw means may be used without departing from the spirit of the present invention.

It is desirable to provide detachable wear plates such as 80 to each of the side plates of pitman 62 in view of the abuse normally encountered in the crushing chamber during operation.

The movable jaw means 60 is also disposed in an inclined position with the upper end adjacent to the feed inlet 82 of the crushing chamber 84 defined between the respective jaws and the pitman side plates.

Preferably the stationary and movable jaw means 39, 60 are inclined such that the crushing chamber formed is inclined between the vertical and the horizontal at an angle less than the angle of repose.

The lower end of chamber 84 includes a discharge opening 85 for the processed material which falls to the discharge conveyor 30.

Toggle arrangement 64 includes an adjustable and replaceable toggle seat 65 mounted on a cross member 67 fixed to the main frame.

Another replaceable toggle seat 69 is provided at the top end where it is connected to pitman 62. Preferably, means for providing for positive retention of toggle 64 in seat 69 are provided in the form of a stop bar 90 which prevents inadvertent unseating of the toggle during adverse operating conditions by limiting the amount of upward movement of side plates 74 which, of course, are fixed to the pitman 62.

Each stop bar 90 is simply mounted to frame 20 by a plurality of bolts 92 and is disposed to extend over a portion of a respective one of side plates 74. A given clearance is provided between each bar 90 and the adjacently disposed shoulder-like portions of the side plates 74 to allow for the limited motion imparted by the eccentric drive means previously described.

By adjustment of the position of toggle arrangement 64, the motion of the feed end of jaw means 60 may be varied according to the most desirable action for a given crushing application.

Further, both toggle arrangements 48 and 64 serve as a safety mechanism as they may be designed to break should uncrushable material enter chamber 84. Being easily replaceable and relatively inexpensive, this provides a safety factor for preventing more serious damage to the other components which represent more difficult and expensive repair or replacement.

In view of the foregoing description, it should be readily apparent that a crushing apparatus constructed in accordance with the present invention provides a unique overall reduced profile combined with the crushing efficiency and capacity to solve a long standing problem in the industry and offers a means to drammatically improve the productivity of mining hard rock and mine ores.

What is claimed is:

1. An improved low profile crushing apparatus for mine ore or hard rock comprising, in combination, a base means; a first crushing jaw means mounted in a releasably fixed position on said base in a vertically inclined position; a second crushing jaw means mounted on a support means and disposed below and spaced from said first jaw means in a similarly vertically inclined position to define a crushing chamber between said respective jaw means, said support means including a supporting toggle arrangement near its upper end mounted on said frame means; eccentric drive means mounted on said frame means and operatively connected to the upper and lower ends of said support means carrying said second jaw means to impart repetitive predetermined motion to said second jaw means relative to said first jaw means; feeding means mounted adjacent to said crushing chamber and means mounted adjacent to the lower end of said crushing chamber to collect and transport material passing through said crushing chamber.

2. The apparatus defined in claim 1 wherein the upper most portion of said second crushing jaw means is disposed lower than the upper most portion of said first jaw means to define a crushing chamber inlet and wherein the upper portion of said material feeding means is disposed at a height substantially equal to the upper most portion of said first jaw means.

3. The apparatus defined in claim 1 wherein said crushing chamber formed between said first and second jaw means is inclined between the vertical and the horizontal at an angle less than the angle of repose.

4. The apparatus defined in claim 2 wherein material is fed into the inlet of said crushing chamber at a position lower than the uppermost portion of said first jaw means.

* * * * *